US010478377B1

(12) United States Patent
Selinger

(10) Patent No.: US 10,478,377 B1
(45) Date of Patent: Nov. 19, 2019

(54) PRECAST TUB

(71) Applicant: Gregory M. Selinger, Carlisle (CA)

(72) Inventor: Gregory M. Selinger, Carlisle (CA)

( * ) Notice: Subject to any disclaimer, the term of this patent is extended or adjusted under 35 U.S.C. 154(b) by 0 days.

(21) Appl. No.: 15/995,497

(22) Filed: Jun. 1, 2018

(51) Int. Cl.
*E04H 4/00* (2006.01)
*A61H 33/00* (2006.01)

(52) U.S. Cl.
CPC ..... *A61H 33/6068* (2013.01); *A61H 33/6005* (2013.01); *E04H 4/0075* (2013.01); *E04H 4/0093* (2013.01)

(58) Field of Classification Search
CPC ..... A61H 33/6005; A61H 33/6068; E04H 4/0093; E04H 4/0075; E04H 4/0012; E04H 4/0087; E04H 4/0081; E04H 4/148
USPC ..... 52/169.7
See application file for complete search history.

(56) References Cited

U.S. PATENT DOCUMENTS

| | | | | |
|---|---|---|---|---|
| 2,902,157 | A | 9/1959 | Culver | |
| 3,859,674 | A | 1/1975 | Thomson | |
| 4,406,439 | A | 9/1983 | Garter | |
| 6,637,162 | B1 | 10/2003 | Holland | |
| 8,225,577 | B1 | 7/2012 | Fender | |
| 8,869,469 | B2 | 10/2014 | Ludlow et al. | |
| 9,719,269 | B2 | 8/2017 | Romano | |
| 2007/0109771 | A1* | 5/2007 | Solana | E04H 4/14 362/153.1 |
| 2015/0337551 | A1* | 11/2015 | Romano | B29C 39/003 4/506 |

* cited by examiner

*Primary Examiner* — Janie M Loeppke
(74) *Attorney, Agent, or Firm* — Edward M. Livingston, Esq.; Bryan L. Loeffler, Esq.; Livingston Loeffler, P.A.

(57) ABSTRACT

A single unit precast concrete tub (1) formed out of concrete wherein a plumbing system (10) and electrical system (11) are encased within preformed concrete walls. The fully encased plumbing system protects the pipes against damage and frost. Support brackets (15) are formed on an exterior surface (4) of the side wall (2) to provide attachment points for hoisting the precast tub for transportation and installation. The support brackets also provide attachment points for building auxiliary structures, such as decks, around the precast tub.

8 Claims, 4 Drawing Sheets

PRECAST TUB

FIELD OF THE INVENTION

This invention relates to hot tubs and swimming pools and more particularly a hot tub or swim spa precast from concrete having a structure that allows the tub to be constructed entirely off-site and then to be transported and installed on-site.

BACKGROUND OF THE INVENTION

The hot tub industry is dominated by fiberglass shell hot tubs. These are typically self-contained units with all of the piping and associated equipment (pumps, filter, heater and so forth) attached to the outside of a thin fiberglass shell. Such tubs are designed to rest on a concrete slab above ground and require an exterior skirt to conceal the piping and mechanical equipment. They may include a set of wooden steps for entry and exit. These tubs typically utilize small electric pumps, filters and heaters due to size constraints.

There are some fiberglass tubs that are designed to drop into the ground, typically adjacent to swimming pools. These tubs utilize similar construction methods and the exposed piping requires the construction of a concrete bunker to protect the unit from frost and ground movement.

All fiberglass tubs utilize the same type of molded shell and interior gel coating. They are generally limited in durability and are considered depreciable components akin to other outdoor consumer products such as barbecues, patio furniture and so forth. They generally have a life span of seven to ten years and would then require disposal. The interior finishes do not lend themselves to economical refurbishment. Such tubs offer no structural strength and thus cannot support any auxiliary structures, perimeter decking and so forth.

Conventional tubs also cannot be customized beyond a limited selection of interior finish colors. They are also typically limited in depth and perimeter size. They are generally designed to be easily installed without heavy equipment so a tub that is too wide or heavy would be cumbersome and be difficult to install. Further, there are severe limitations on the capabilities of the self-contained heating and filtration systems which necessitates a limited water volume. There are some larger self-contained swim spa hybrids available but they too utilize the same construction techniques and suffer from limited durability, structural integrity and so forth and thus, are also considered a depreciating consumable product.

These conventional fiberglass tubs comprise the vast majority of the hot tub market. There are a few other types of tubs available using other materials such as wood, or vinyl over prefabricated steel but they suffer from many of the aforementioned limitations and comprise a tiny fraction of the spa market.

If a consumer wants a product that does not suffer from the limitations of the fiberglass tubs then he or she will need to move on to a custom concrete hot tub. This is almost always accomplished by contacting a local concrete swimming pool contractor and scheduling an installation. The contractor will then construct a solid concrete tub on the owner's property utilizing either formed and poured concrete or shotcrete concrete placement technology. This type of hot tub, if installed correctly, relieves the aforementioned limitations of the fiberglass tub.

For example, concrete tubs constructed on site utilize mechanical equipment that is located some distance away from the structure. There is typically a piping trench that leads away from the tub to a remote location where the equipment is located. This allows the installation of any type of equipment. Higher quality equipment can be used, permitting larger water volumes and consequently larger, and more elaborate structures. Any type of fuel source can be used for the heating system which dramatically improves efficiency (99 percent of fiberglass tubs use inefficient electric heaters). Larger pumps can be used which increase the performance of the jets. Also, much larger filtration and sanitation systems can be used which improve the ease of maintenance and the water quality in the tub. Many more automation and control options are available with remotely located equipment.

Further, the equipment can be serviced, replaced or updated at any time without affecting the actual structure of the tub. If more technologically advanced componentry becomes available it can be easily installed. This ensures top performance of the tub for decades, as the actual structure of the tub is non-degrading.

Another big advantage of concrete tubs is in the customization and durability of the finishes. Concrete tubs typically utilize a either a formed and poured or natural stone coping (this is the top edge of the tub). They then use a tile interior banding at the water level. This tile is often laid about 12" wide and then the balance of the hot tub interior is finished in a cementitious material such as plaster or Marbelite. Often, the whole interior of the tub is finished in mosaic tile. Other interior options include solid marble or granite.

As one could imagine, there are an infinite number of combinations for the coping, tile, plaster, marble or granite interior finishes which results in almost every concrete tub being unique. These finishes also offer unparalleled durability if installed correctly. They also lend themselves to easy refurbishment or replacement later on if required.

However, concrete tubs fabricated and poured on site have their own set of limitations.

One limitation stems from the fact that only a small percentage of the market is serviced by a capable concrete contractor. Because the work is all done on site, if a customer is not within close proximity to a reputable concrete swimming pool builder, he or she is out of luck. It is not economical for the builder to travel a long distance to construct the tub as it requires many small processes spread over several weeks. Even if the client has a geographically proximate contractor the builder may lack the technical knowledge to construct the product properly. There are very few building standards in this industry which results in widely disparate product quality.

Assuming that the client can locate a reputable and capable contractor, limitations are caused by the fact that the work will take place on site over a period of several weeks. This is because the construction of the product is quite complex and requires many separate stages, often involving curing time in between steps. This work is, of course, weather permitting, which limits the number of working days, especially in colder climates. The weather can also impact the product quality severely resulting in unacceptable variation.

As mentioned above, there is almost no standardization in the industry, which results in low product consistency. The quality of the product is completely dependent upon the capabilities of the local contractor and the conditions under which the product is installed. There is also the inconvenience and increased cost of a large construction site over a fairly long period of time.

For these reasons, the concrete tub has enjoyed fairly limited traction in the marketplace. Although almost any concrete tub is superior to any preformed fiberglass tub, they are generally plagued by high cost, inconvenience, variable product quality and limited availability.

Therefore, a need exists for a precast concrete tub that eliminates the deficiencies inherent in both conventional pre-constructed fiberglass tubs and concrete hot tubs that are built onsite.

SUMMARY OF THE INVENTION

The primary object of the present invention is to provide a fully finished precast concrete hot tub, or hybrid swim or small pool (hereinafter collectively referred to as a "tub") using re-usable forms and assemblies.

An additional object of the present invention is to provide a precast concrete tub that constructed off site in a manufacturing facility.

An additional object of the present invention is to provide a precast concrete tub wherein all componentry, such as piping, jets, surface skimmers, suction fittings, lighting and so forth, is fully encapsulated within the concrete structure.

An additional object of the present invention is to provide a precast concrete tub that only requires a single mechanical trench leading from the tub to mechanical equipment, which can be located some distance away.

An additional object of the present invention is to provide a precast concrete tub having a single connection manifold where all hookups are completed leading to the mechanical equipment An additional object of the present invention is to provide a precast concrete tub wherein there are no exposed pipes or fittings on the exterior of the structure, thereby protecting the piping and componentry from damage caused by transport and/or from ground conditions after installation including frost heave.

An additional object of the present invention is to provide a precast concrete tub wherein a smooth exterior can also be finished in tile or stone veneer if it is to be exposed.

An additional object of the present invention is to provide a precast concrete tub that can be installed either in ground, on ground or partially buried and does not require an auxiliary bunker to protect it from the surrounding backfill when installed in the ground.

An additional object of the present invention is to provide a precast concrete tub having solid steel reinforced concrete, which can support auxiliary structures and/or surrounding decking.

An additional object of the present invention is to provide a precast concrete tub having exterior supports that allow for removable steel brackets to be attached for support the tub during movement. These brackets eliminate interior grommets or any grommets in the coping.

An additional object of the present invention is to provide a precast concrete tub having no grommets in the interior or the top surface (coping), thereby allowing these surfaces to be finished completely prior to delivery.

An additional object of the present invention is to provide a precast concrete tub wherein all interior and exterior finishes can be completed prior to delivery in controlled conditions, thereby reducing on site construction time by over 90 percent and ensuring consistent product quality.

An additional object of the present invention is to provide a precast concrete tub that is capable of withstanding transport and can me moved from a production facility to an installation location using widely available modes of transport and delivery.

An additional object of the present invention is to provide a precast concrete tub wherein Styrofoam, engineered voids, and/or lightweight concrete may be considered as long as structural integrity is maintained. These materials may be used to reduce weight to ease transport and delivery An additional object of the present invention is to provide a precast concrete tub that can be constructed using steel reinforced concrete to provide all of the aforementioned advantages inherent in concrete construction. The product is designed to rival the finest concrete cast in place structures in all metrics.

An additional object of the present invention is to provide a precast concrete tub that is manufactured in a controlled environment using standardized forms and assemblies, thereby providing a level of precision and quality not currently attainable in the concrete spa industry, wherein concrete spa are constructed on-site.

The present invention fulfills the above and other objects by providing a single unit precast concrete tub formed from concrete wherein the plumbing for the circulation system and jets and electrical systems are encased within preformed concrete walls. The fully encased plumbing system protects the pipes against damage and frost. Support brackets are formed on an exterior surface of the side wall to provide attachment points for hoisting the tub. The brackets also provide attachment points for building auxiliary structures around the precast tub. The precast tub may be cast using various shaped molds to create circular or rectangular tube that can be used as hot tubs, swim spas, swimming pools and so forth depending on the size of the end product.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
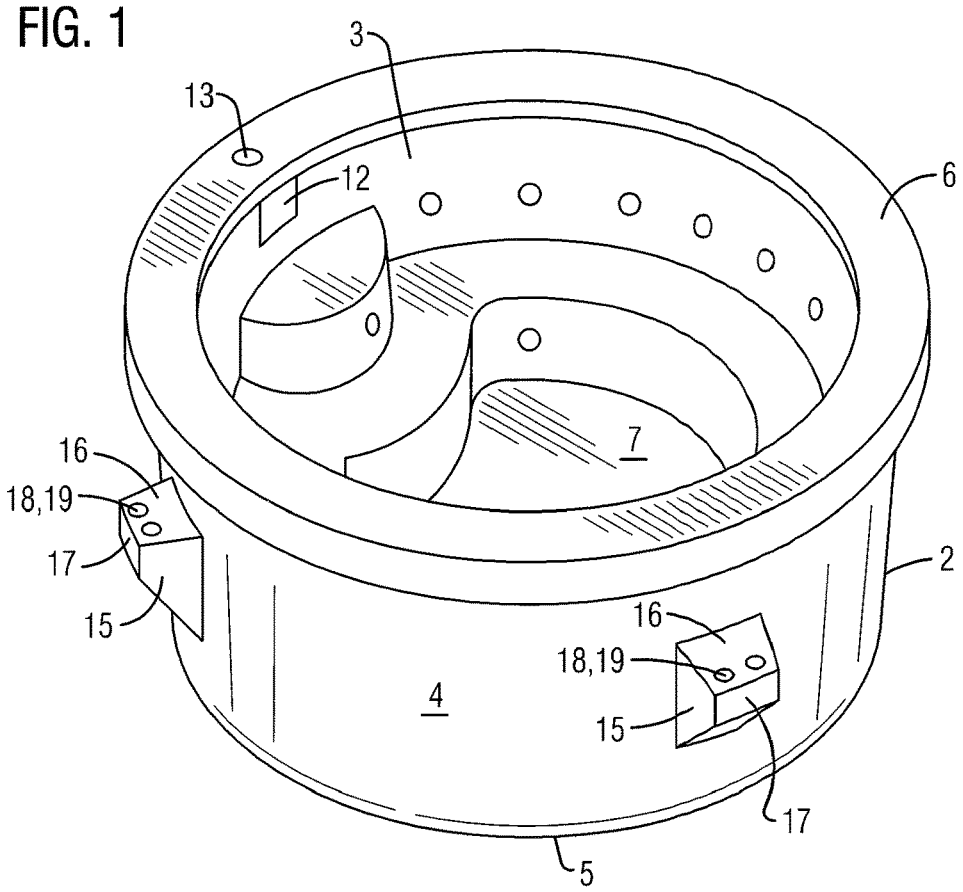
FIG. 1 is an upper perspective view of a precast tub of the present invention.
Figure 2:
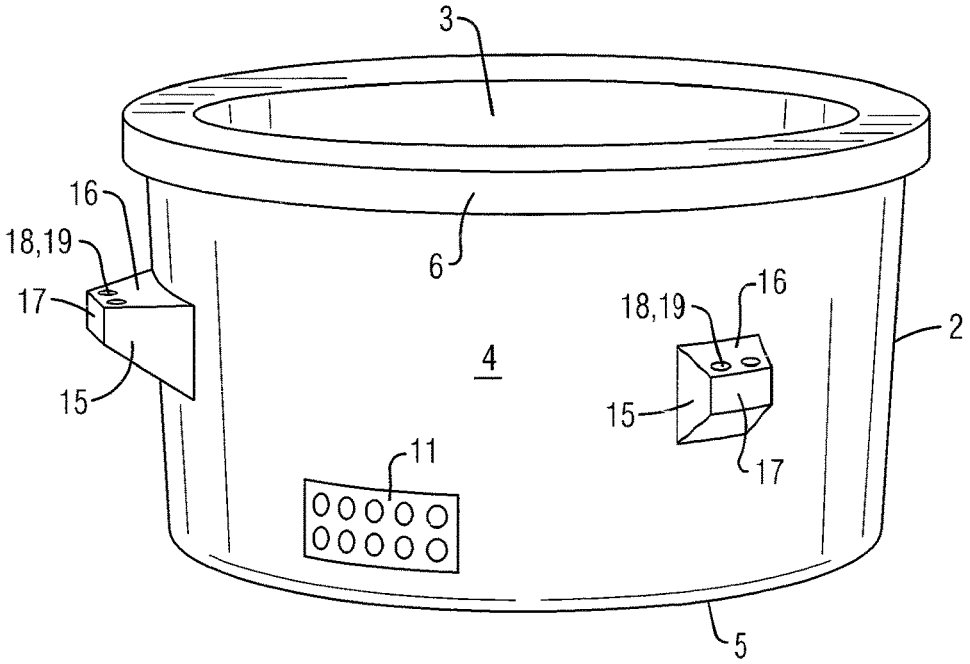
FIG. 2 is side perspective view of side supports extending form a side surface of a precast tub of the present invention and connection manifold.

For purposes of describing the preferred embodiment, the terminology used in reference to the numbered accessories in the drawings is as follows:

1. precast tub, generally
2. perimeter side wall
3. interior surface of perimeter side wall
4. exterior surface of perimeter side wall
5. bottom edge of perimeter side wall
6. top edge of perimeter side wall
7. floor
8. concrete
9. reinforcing steel
10. plumbing system
11. electrical system
12. skimmer
13. skimmer access
14. manifold
15. support bracket
16. a top perpendicular support surface
17. side parallel support surface
18. attachment means
19. embedded nut
20. hoisting bracket
21. auxiliary structure
22. interior finish
23. exterior finish
24. coping With reference to FIG. 1-7, a precast tub 1 of the present invention is illustrated. The precast tub 1 of the present invention comprises at least one perimeter side wall 2, which may be circular, oval-shaped, rectangular-shaped and so forth. The at least one perimeter side wall 2 comprises an interior surface 3, an exterior surface 4, a bottom edge 5 and a top edge 6. A floor 7 extends from the bottom edge 5 of the at least one perimeter side wall 2 to enclose a bottom portion of the precast tub 1.

Figure 3:
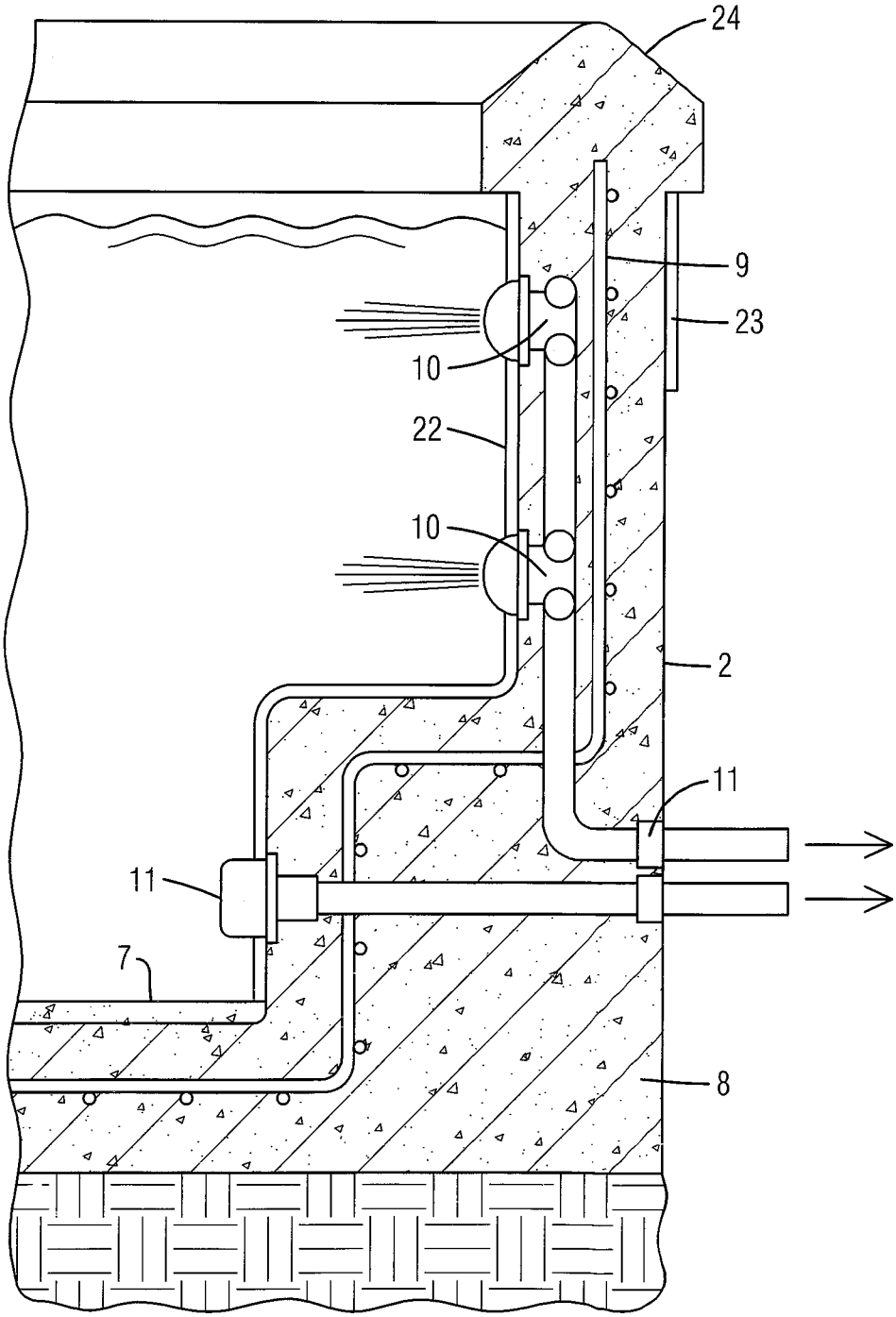
FIG. 3 is sectional view along line A-A of FIG. 2 showing encased components, plumbing and reinforcing steel of a precast tub of the present invention.

The precast tub 1 of the present invention is preferably constructed by pouring concrete 8 into forms wherein reinforcing steel 9, a plumbing system 10 and an electrical system 11 are fully encased within the preformed concrete walls, as illustrated in FIG. 3. The plumbing system 10 may comprise a circulation, filtration and jet systems. The electrical system 11 may comprise lighting, timers, thermostats, electronic controls and so forth. The fully encased plumbing system 10 and electrical system 11 protects pipes and other components against damage caused during installation and from freezing and frost. A specially designed narrow-bodied in-wall skimmer 12 allows the skimmer to be encased within the at least one perimeter side wall 2 and have an access 13 located on the top edge 6 of the at least one perimeter side wall 2 as opposed to being installed on the exterior surface 4 of the at least one perimeter side wall 2 as is the case with conventional hot tubs and pool installations.

At least one connection manifold 14 is located within the at least one perimeter side wall 2 and exposed on the exterior surface 4 to allow the plumbing system 10 to be connected to exterior pumps, filters, heaters and so forth. The electrical system 11 may also be connected to an exterior power source and so forth through the manifold 14. The manifold 14 allows for electrical and plumbing components of the precast tub 1 to be hooked up in a single location that provides a "plug and play" connection, which is accessible for future maintenance if necessary.

A plurality of support brackets 15 are formed on the exterior surface 4 of the at least one perimeter side wall 2 wherein each support bracket 15 extends from the exterior surface 4 and provides a top perpendicular support surface 16 and/or a side parallel support surface 17.

Figure 5:
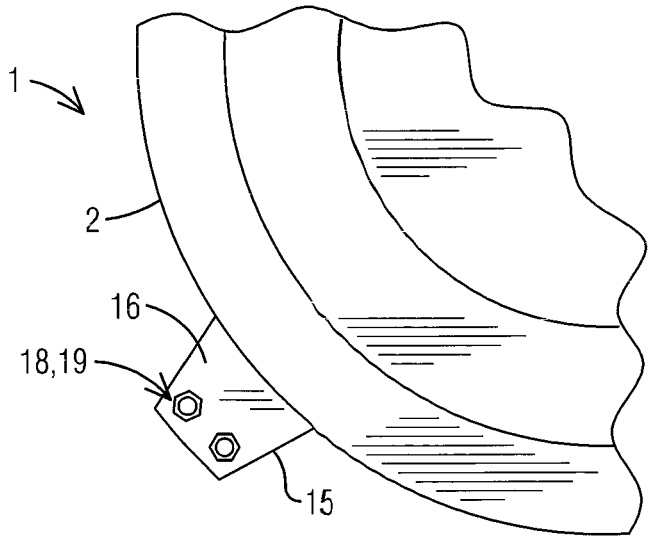
FIG. 5 is a top view of a side support of a precast tub of the present invention having embedded nuts located on a top surface thereof.

Each top perpendicular support surface 16 is perpendicular to the at least one perimeter side wall 2, as illustrated in FIGS. 1 and 5, and may provide attachment means 18, such as embedded nuts 19, that are cast into the concrete 8 used to east the support brackets 15.

Figure 4:
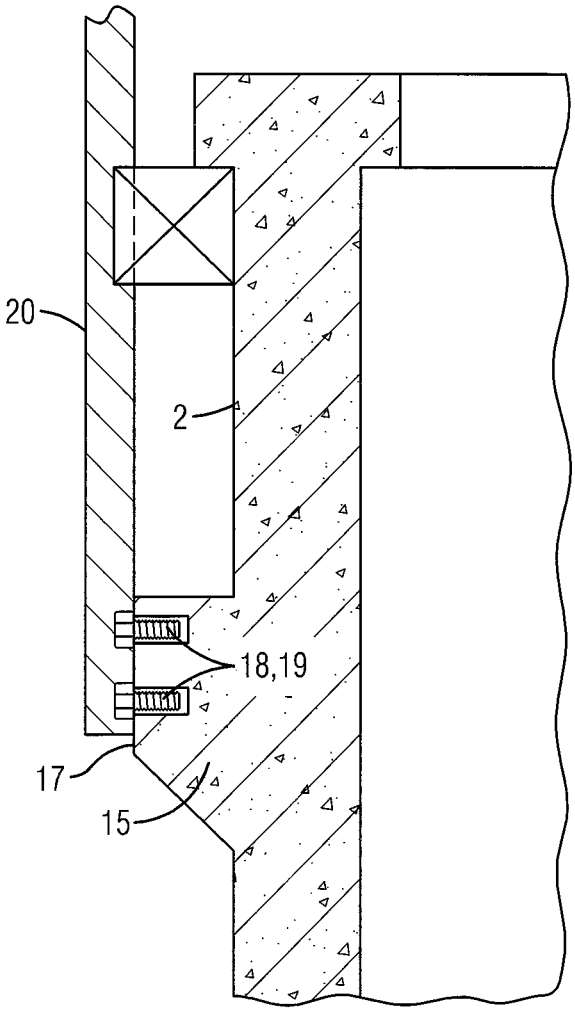
FIG. 4 is a partial cutaway side view of a precast tub of the present invention having hoisting brackets secured to side supports.

Each side parallel support surface 17 is parallel to the at least one perimeter side wall 2, as illustrated in FIG. 4, and may provide attachment means 18, such as embedded nuts 19, that are cast into the concrete 8 used to cast the support brackets 15.

Figure 6:
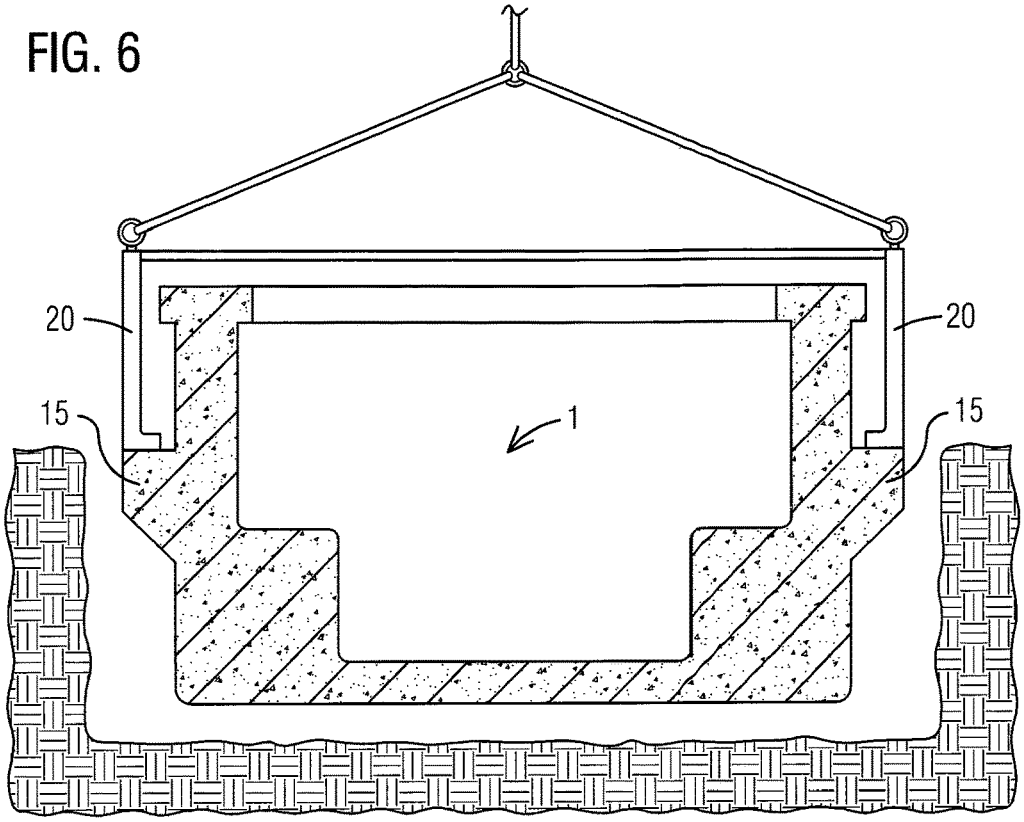
FIG. 6 is a side view of a precast tub of the present invention being hoisted using hoisting brackets secured to side supports.
Figure 7:
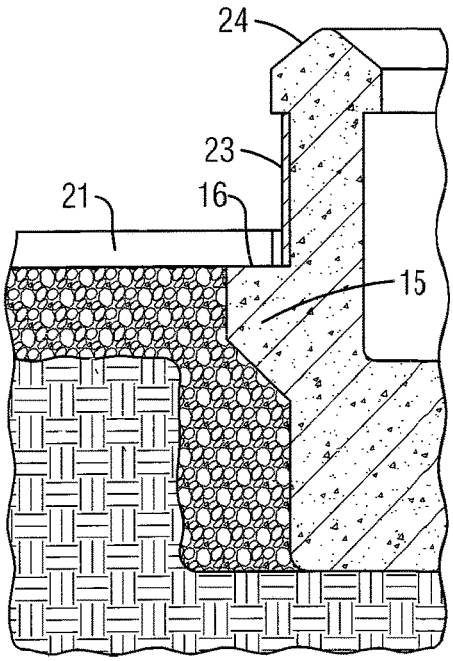
FIG. 7 is a partial cutaway side view of a precast tub of the present invention installed.

The support brackets 15 provide attachment points for securing hoisting brackets 20 to the precast tub 1 to allow the precast tub 1 to be moved and transported, as illustrated in FIGS. 4 and 6. The support brackets 15 also provide attachment points for building auxiliary structures 21 around the precast tub, as illustrated in FIG. 7 wherein a deck is secured to the support bracket 15 and supported by the support bracket 15.

The precast tub 1 may be finished prior to transportation from a factory and installation, as illustrated in FIG. 3. An interior finish 22 may comprise tile, stone veneer, protective coating and so forth. Likewise, an exterior finish 23 may comprise tile, stone veneer and so forth. The top edge 6 of the at least one perimeter side wall 2 may be finished with a coping 24.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A precast tub comprising:

at least one perimeter side wall having an interior surface, an exterior surface, a bottom edge and a top edge;

a floor extending from the bottom edge of the at least one perimeter side wall to enclose a bottom portion of the precast tub;

said at least one perimeter side wall and floor being constructed out of precast concrete;

a plumbing system encased within said concrete of said at least one perimeter side wall;

an electrical system encased within said concrete of said at least one least one perimeter side wall; and a connection manifold located on the exterior surface of said at least one perimeter side wall wherein said plumbing system and said electrical system are connected to said connection manifold to allow said plumbing system and said electrical system to be connected to outside power sources.

2. The precast tub of claim 1 further comprising:

a plurality of support brackets formed on the exterior surface of the at least one perimeter side wall wherein each support bracket extends from the exterior side surface of the at least one perimeter side wall and provides a top perpendicular support surface.

3. The precast tub of claim 2 further comprising:

at least one attachment means cast into each support bracket on the top perpendicular support surface.

4. The precast tub of claim 3 further comprising:

at least one hoisting bracket that is attachable to the top perpendicular support surface of each support bracket.

5. The precast tub of claim 1 further comprising:

a plurality of support brackets formed on the exterior surface of the at least one perimeter side wall wherein each support bracket extends from the exterior side surface of the at least one perimeter side wall and provides a side parallel support surface.

6. The precast tub of claim 5 further comprising:

at least one attachment means cast into each support bracket on the side parallel support surface.

7. The precast tub of claim 6 further comprising:

at least one hoisting bracket that is attachable to the side parallel support surface of each support bracket.

8. A precast tub comprising:

at least one perimeter side wall having an interior surface, an exterior surface, a bottom edge and a top edge;

a floor extending from the bottom edge of the at least one perimeter side wall to enclose a bottom portion of the precast tub;

said at least one perimeter side wall and floor being constructed out of precast concretes;

a plumbing system encased within said concrete of said at least one perimeter side wall;

an electrical system encased within said concrete of said at least one perimeter side wall;

a connection manifold located on the exterior surface of said at least one perimeter side wall wherein said plumbing system and said electrical system are connected to said connection manifold to allow said plumbing system and said electrical system to outside power sources;

said plumbing system connecting a plurality of plumbing components to said connection manifold; and said electrical system connecting a plurality of electrical components to said connection manifold.

* * * * *